United States Patent [19]

Osterholm

[11] Patent Number: 5,076,547

[45] Date of Patent: Dec. 31, 1991

[54] APPARATUS AND METHOD FOR COLLAPSIBLE HANDRAIL

[76] Inventor: Charles D. Osterholm, P.O. Box 3000, Bellingham, Wash. 98227

[21] Appl. No.: 455,261

[22] Filed: Dec. 22, 1989

[51] Int. Cl.[5] ..... E04H 17/14

[52] U.S. Cl. ..... 256/67; 52/150; 296/156

[58] Field of Search ..... 256/67, 65, 59; 403/108, 109; 52/150, 183; 182/106, 113; 296/156, 162

[56] References Cited

U.S. PATENT DOCUMENTS

| | | | |
|---|---|---|---|
| 3,463,457 | 8/1969 | Alexander | 256/65 X |
| 4,006,564 | 2/1977 | Wiese | 256/65 X |
| 4,029,352 | 6/1977 | Evans | 256/65 X |
| 4,030,255 | 6/1977 | Hartman | 256/67 X |
| 4,193,229 | 3/1980 | Hartman | 256/67 X |
| 4,261,550 | 4/1981 | Gregory | 256/67 |
| 4,392,660 | 7/1983 | Mason et al. . | |
| 4,644,227 | 5/1987 | Hansen . | |
| 4,856,761 | 8/1989 | Berner | 256/67 X |
| 5,024,420 | 6/1991 | Downing | 256/67 |

*Primary Examiner*—Peter M. Cuomo
*Attorney, Agent, or Firm*—Hughes & Multer

[57] ABSTRACT

A collapsible handrail apparatus is disclosed for being mounted on a wall structure adjacent a doorway. The handrail apparatus comprises mounting fixtures by which a handrail structure can be pivotally connected to the wall structure. A bracing bar is connected between the wall structure and a post member of the handrail structure. The handrail structure has a first collapsed position adjacent to the wall structure and a second extended position in which a handrail portion extends from the wall structure so as to be positioned for handrail support.

18 Claims, 11 Drawing Sheets

APPARATUS AND METHOD FOR COLLAPSIBLE HANDRAIL

BACKGROUND OF THE INVENTION

1. Field of the Invention

The present invention relates generally to handrails which are attached to a wall structure near a doorway opening, and more particularly to handrails of a folding or collapsible kind.

2. Background Art

Users of recreational vehicles such as travel trailers, fifth wheel vehicles, motor homes, and the like need a safe handrail which can be grasped when the persons, who may be of varying ages and heights, enter and exit a doorway to the vehicle. The handrail desirably is easily stored during periods of nonuse, such as when the vehicle is in motion, and desirably is rigid when the handrail is positioned in an operating position.

Handrails which are positioned and attached alongside a doorway to a structure, such as a recreational vehicle, are well known. A search of the U.S. Patent literature has developed the following patents:

Hansel U.S. Pat. No. 4,644,227 shows a completely rigid handrail apparatus which attaches to the side of a vehicle and which extends outwardly and downwardly to a vertical post 38 which rests on a platform or step assembly 20 which in turn rests on the ground.

Mason et al U.S. Pat. No. 4,392,660 et al) shows a safety bar for use in a cab of an earth moving vehicle. The safety bar folds away from the doorway area of the vehicle.

Gregory U.S. Pat. No. 4,261,550 shows an upwardly and downwardly foldable handrail which is connected hingedly to the side of a trailer home adjacent a doorway. The apparatus folds downwardly against the wall of the vehicle for storage. The device extends and locks into its extended position.

Evans U.S. Pat. No. 4,029,352 shows a foldable handrail which comprises a strut 21 (FIG. 2). The strut 21 is connected at one end to a bracket 23, which is anchored at a low location on the side of the vehicle, and at the opposite end to a pair 20 of tubular handrails which are pivotally mounted to the wall at an upper location. The strut 21 does not connect directly to the pair 20 of tubes, but rather has a throw bar 24 (FIG. 6) which attaches at 26 to the tubes. Also, there is a stabilizer strap 41, which is fixedly attached to the strut 21 and which is pivotally attached to the bracket 23.

SUMMARY OF THE INVENTION

A collapsible handrail apparatus adapted to be mounted to a wall structure, such as a side wall of a vehicle, comprises: A handrail structure; a mounting means by which said handrail structure can be pivotally connected to said wall structure; and a bracing bar means. The handrail structure has a handrail portion and has a first collapsed position adjacent to the wall structure and a second extended position in which the handrail portion extends from the wall structure so as to be positioned for handrail support. The mounting means enables the handrail structure to be pivotally connected to the wall structure at a first and a second spaced mounting locations for pivotal movement of the handrail structure between the first and second positions. The bracing bar means has a first end adapted to be connected to the wall structure at a first bracing location spaced from a line drawn through the two mounting locations, and a second end connected to the handrail structure at a second bracing location spaced from the line extending through the two mounting locations when the handrail structure is in the second extended position.

The bracing bar means is characterized in that the bracing bar means can be extended and retracted so that a distance between the first and second bracing locations can be changed in moving the handrail structure between the first and second positions.

The first and second mounting locations are positioned so that the line extending through the first and second mounting locations has a substantial vertical alignment component.

The handrail structure may be mounted for pivotal movement about an axis parallel to the line extending through the first and second mounting locations whereby the handrail structure pivots in a horizontal direction between the first and second positions.

The handrail structure may be mounted for pivot movement about an axis means substantially transverse to the line extending through the two mounting locations. The handrail structure may comprise a post member having a substantial vertical alignment component in both of the first and second positions, and two arm members connecting at outer ends thereof to the post member and at inner ends thereof to the wall structure. The two arm members and post member may comprise a parallel linkage. The bracing bar means may comprise at least two bracing bars having outer ends connected to the handrail structure at vertically spaced locations, and two inner ends mounted to the wall structure, wherein the bracing bar is pivotally connected to the handrail structure and also pivotally connected with universal joint connections to the wall structures, wherein the bracing bars are telescoping bars.

In an embodiment in which the handrail structure is pivotally mounted about a generally vertically aligned axis extending through the two mounting locations, the second bracing location at which the second end of the bracing bar means is connected to the handrail structure may be spaced horizontally from the axis of rotation when the handrail structure is in either of the first or second positions, wherein the bracing bar means comprises at least one telescoping bracing member extended between the first and second bracing location, and the handrail structure may be a substantially rigid structure.

The collapsible handrail apparatus may comprise just the handrail structure comprising a vertically aligned post member and upper and lower mounting arms having first outer ends connected to the post member at upper and lower connecting locations, and second inner ends adapted to be pivotally connected to the wall structure at upper and lower spaced mounting locations, in a manner that the handrail structure can be moved between a first collapsed position where the post member and the arms are positioned adjacent to the wall structure and a second extended position where the post member is spaced from the wall structure and the two arms extend outwardly from the wall structure to the post member, the post member maintaining a substantially vertically alignment component in moving between the first and second positions.

DESCRIPTION OF THE PREFERRED EMBODIMENT

Figure 1:
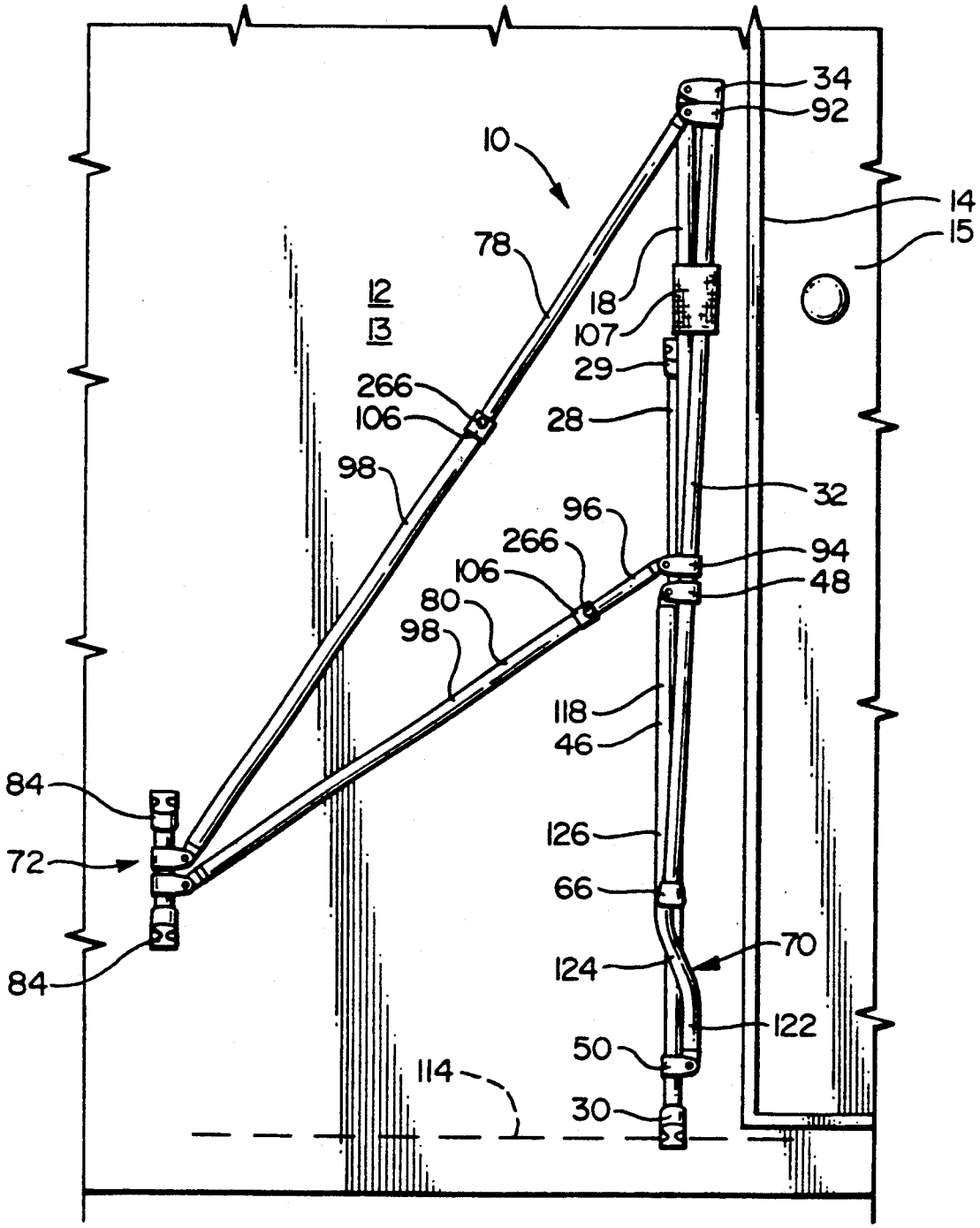
FIG. 1 is a front view of a collapsible handrail assembly of the present invention in a collapsed position, with the assembly being mounted alongside a doorway of a recreational vehicle.
Figure 3:
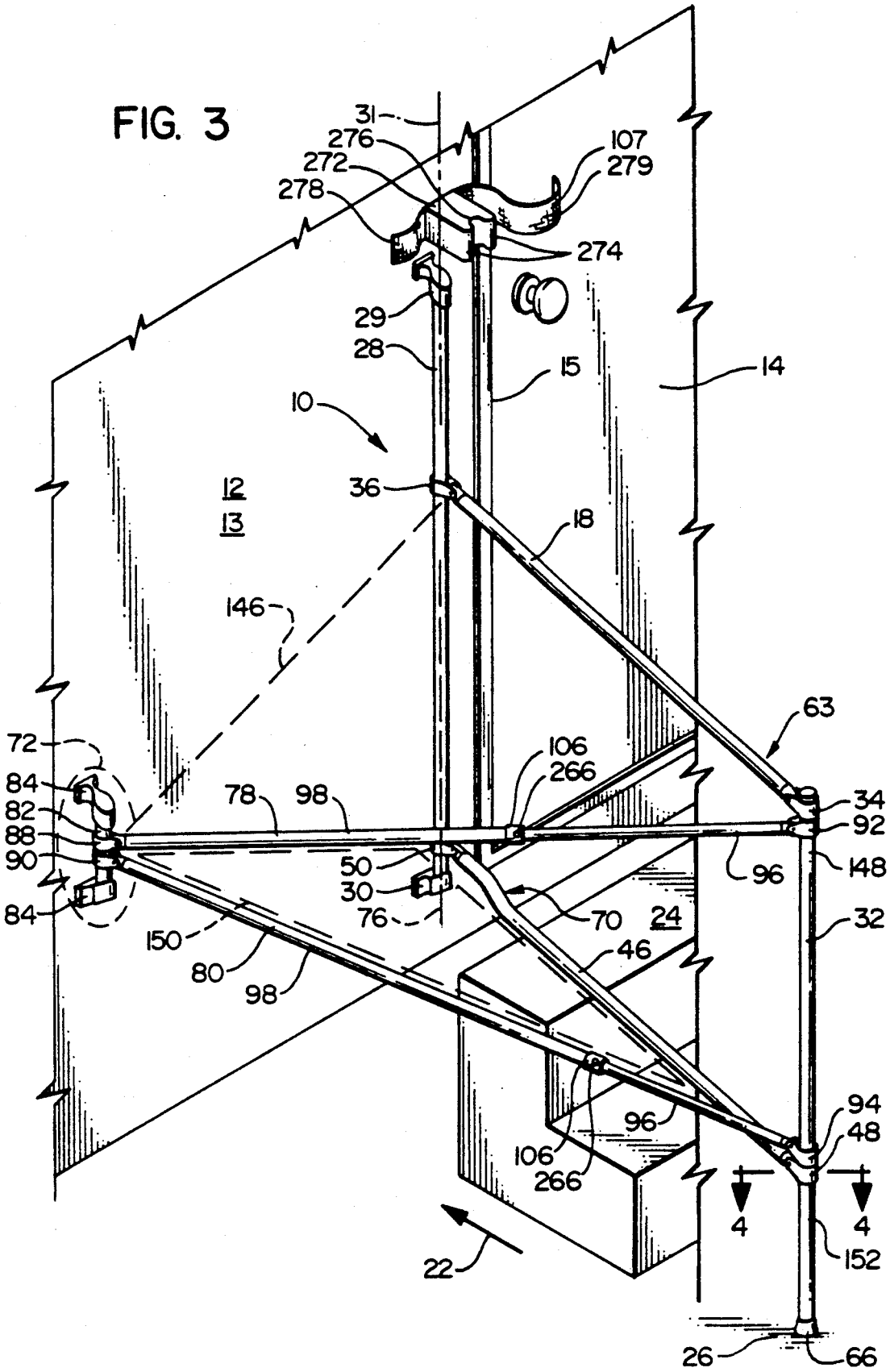
FIG. 3 is a perspective view from the front and the left of the collapsible handrail in an extended or operating position engaged with the ground.

A first embodiment of a handrail assembly generally indicated at 10 and shown in its collapsed position in FIG. 1 and its extended or operating position in FIG. 3, is mounted to a side wall 12 of a recreational vehicle or van 13 adjacent, and to a left side of, a doorway 14 which has a door 15. As will be described, the assembly 10 of the first embodiment comprises a vehicle-mounted vertical rotation shaft which is connected by a vertically pivoting handrail or upper arm 18 and by a vertically pivoting lower arm to a generally vertical outer post which in turn is connected pivotally to a pair of leftwardly extending telescoping braces which are anchored to the vehicle 13. After initially describing this structure, it will be explained that from the collapsed position of FIG. 1 the assembly 10 is unlocked and moved downwardly and forwardly. During the downward forward movement the telescoping brace members are free to change their lengths and the pivoting arms as well as the telescoping braces freely pivot. Consequently, the assembly 10 is able to be moved freely from the collapsed position to various orientations relative to the vehicle 13, both in terms of vertical position of the outer post and in the terms of angular orientation of the pivoting arms, in a manner that the assembly 10 may be selectively positioned in a desired operating position. Another feature that will be explained is that in the operating position the assembly 10 is locked and in this locked mode constitutes a rigid structure, suitable for supporting substantial loads on the handrail 18. It is also to be explained how a height of the handrail 18 is adjustable for persons of varying heights, and how the rotatability of the inner shaft combined with a shape of the lower pivoting arm that is kinked accommodates the collapsing of the assembly 10 into a compact bundle against the vehicle 13.

The use of the terms "rearward" or "rearwardly" will denote, as shown by the arrow 22 in FIG. 3, a direction toward, or a proximity to, the sidewall 12, while the terms "forward" and "forwardly" will denote the opposite. A person exiting the doorway 14 descends steps 24 to the ground 26.

Referring now to the perspective view FIG. 3 of the handrail assembly 10 in its operating position, there is a first inner shaft 28 which is mounted with upper and lower ends, respectively, engaged in identical upper and lower mounting fixtures 29 and 30, respectively, attached to the side wall 12, so that the shaft 28 is mounted close to the side of the vehicle 13 for free rotation about a vertical axis 31. Spaced forwardly from the shaft 28, there is a generally vertical outer post 32 which in the operating position engages the ground 26. The upper arm 18 is connected pivotally both to a shoe 34, which is attached rigidly to an upper end of the outer post 32, and to an identical shoe 36, which is attached rigidly to an upper portion of the inner shaft 28. There is additionally a lower parallel arm 46 which is connected pivotally to a shoe 48, which is attached rigidly to a lower portion of the outer post 32, with the lower arm 46 being also connected pivotally to an identical shoe 50 which is attached rigidly to a lower portion of the inner shaft 28.

Together, the outer post 32, the upper arm 18, the inner shaft 28, and the lower arm 46, constitute a collapsible parallel linkage or parallelogram 63. In a mode in which telescoping braces (to be introduced presently) are unlocked, the outer post 32 is free to swing laterally about the vertical axis 31 of the rotatable inner shaft 28 during the movement of the outer post 32 between the operating position and the collapsed position, and the outer post 32 may readily be moved up and down. Yet, the outer post 32 is maintained generally parallel to the inner shaft 28, that is, vertically, and is kept generally in a plane of the parallelogram 63. (There is some play in the structure which permits the outer post 32 to twist vertically, but this twist is inhibited and the structure becomes rigid when the locks to be described are locked). The post 32 engages the ground at a tip, 66 which is a friction tip.

As best shown in FIG. 3, there is an anchor fixture or universal joint fixture 72 (encircled by a dashed line) mounted on the side wall 12 at a location that is spaced leftwardly from an imaginary line 76 which is drawn through the locations (29, 30) where the parallelogram 63 is mounted to the side wall 12, Extending leftwardly and rearwardly from the outer post 28 there are an upper telescoping brace 78 and an identical lower telescoping brace 80, with the braces 78, 80, both attaching pivotally at rearward ends to the anchor fixture 72. The anchor fixture 72 comprises a second shaft 82, the two ends of which are each mounted in identical mounting fixtures 84 fixedly attached to the side wall 12 for rotatable mounting of the second shaft 82, and the fixture 72 also comprises identical shoes 88 and 90, respectively, which have been slipped onto the second shaft 82 and which are connected pivotally to the upper brace 78 and the lower brace 80, respectively. The second shaft 82 may be installed in vertical, or horizontal, or other orientations). The braces 78 and 80, respectively, are connected pivotally to a shoe 92 positioned on an upper portion of the outer post 32 and to an identical shoe 94 positioned on a lower portion of the outer post 32, both of which are attached rigidly to the outer post 32. The upper and lower braces 78–80 each comprise a thin shaft 96 which is slideably engaged in a tubular outer sleeve 98. Notably, each brace 78–80 has a screw lock 106 which has a locked position that restrains its related brace 78–80 from changing length, and an unlocked position which permits its related brace 78–80 readily to change length.

Having described the basic structure, let us turn now to describing the position and action of the components as the assembly 10 moves from the collapsed position to the extended position and back again to the collapsed position.

Figure 8:
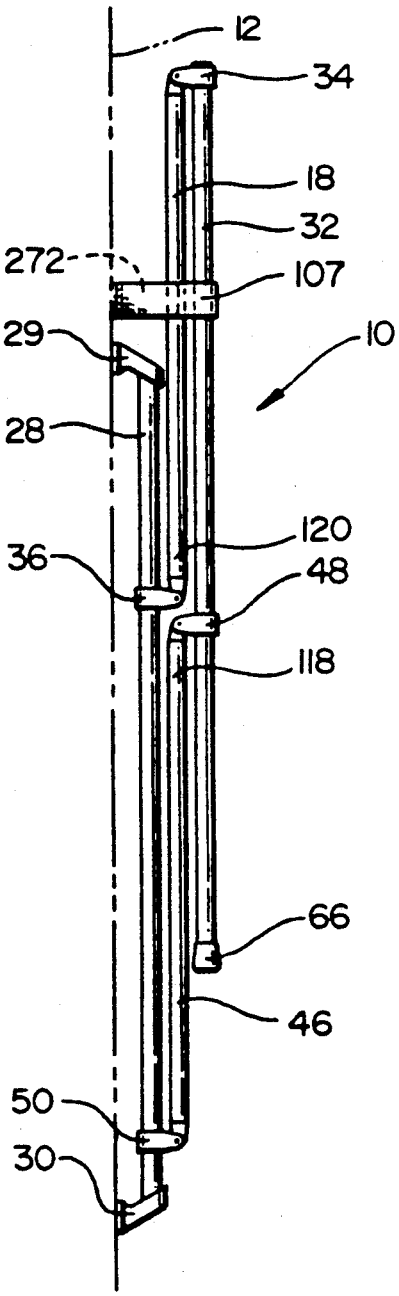
FIG. 8 is a side view from the left of the collapsible handrail in the collapsed position with telescoping brace bars removed to illustrate the position of members of a collapsible parallelogram.

To start with position of the components in the collapsed position, which is shown both in FIG. 1 and in a side view of FIG. 8 (which for ease of illustration, omits the braces 78,80), it is helpful for orientation to note that in the collapsed position the first shaft 28 is practically adjacent to the side wall 12. The other members of the parallelogram 63, that is, the lower arm 46, the upper arm 18, and the outer post 32, are then stacked upwardly and outwardly in relation to the inner shaft 28. The parallelogram 63 is held in place in the collapsed position against the side wall 12 by a strap 107. As shown in FIG. 1 in the collapsed position, the upper telescoping brace 78 is at its maximum length, while the lower telescoping brace 80 is at its minimum length. It is also to be noted that in the collapsed position as shown in the top view of FIG. 5, an angle efg that a line ef through the outer post 32 and the first shaft 28 makes with a line fg through the first shaft 28 and the second shaft 82 is relatively large, as, for example, 1100 to 1450, depending on where the outer post 32 seats relative to the upper rail 18 and the first shaft 28, while an angle fge that the line fg makes with a line ge through the second shaft 82 and the outer post 32 is only a few degrees.

Figure 2:
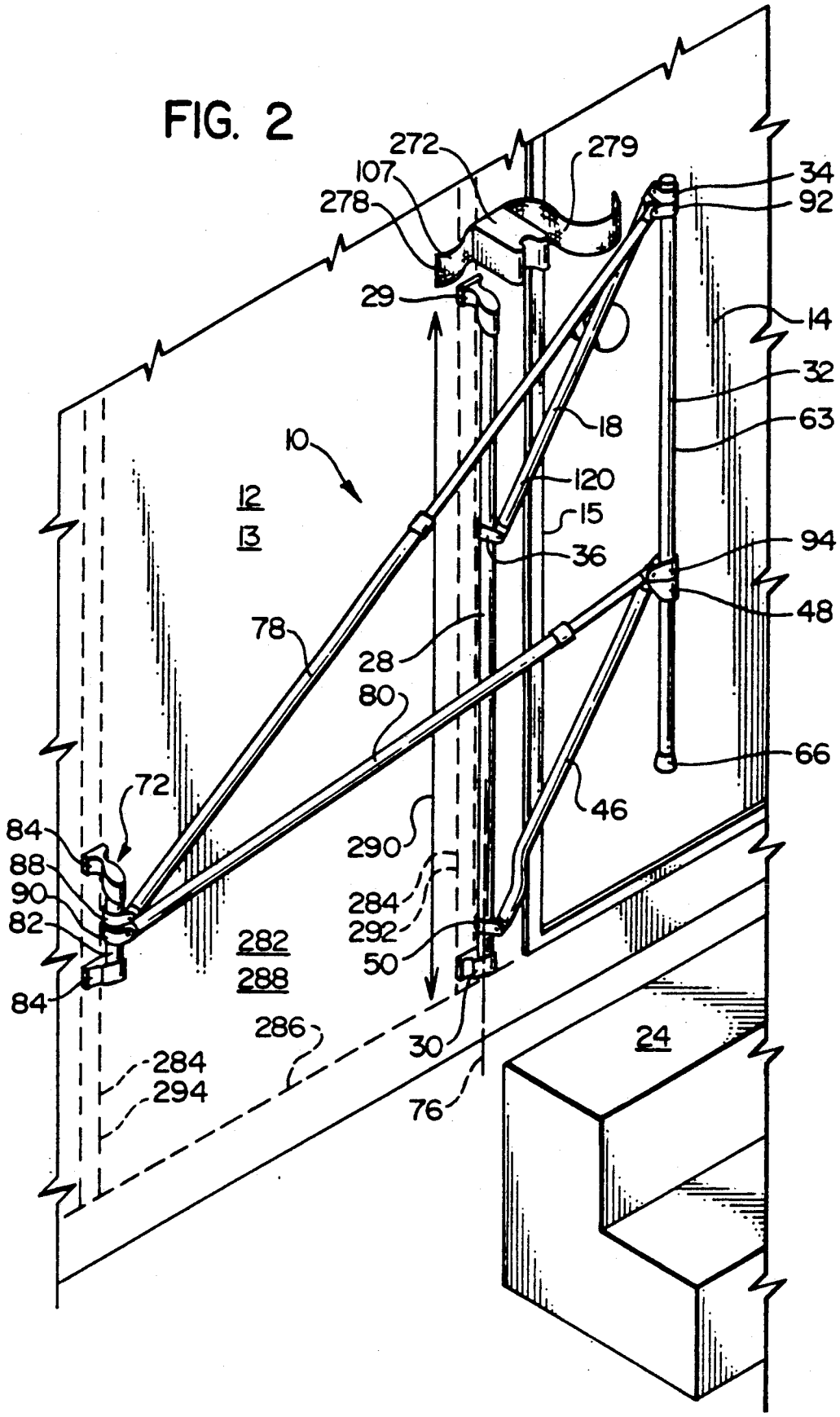
FIG. 2 is a schematic perspective view from the front and left of the collapsible handrail of FIG. 1 which has been lowered to an intermediate position.

Assuming that it is desired now to extend the handrail assembly 10 from the collapsed position, first the strap 107 is unfastened and it is ascertained that the two locks 106 are unlocked. As the outer post 32 is drawn forwardly and downwardly as seen in FIG. 2, the parallelogram 63 will unfold, the upper brace 78 will shorten, the lower brace 80 will lengthen, and both shafts 28 and 82 shown in the top view of FIG. 6 will rotate, which will permit the angle efg to change and the angle fge to increase, so that the handrail assembly 10 will reach an intermediate position of FIGS. 2, 6. As the handrail assembly 10 moves from the intermediate position to the operating position as shown in FIGS. 3, 7, the upper and lower braces 78 and 80, respectively, will continue to shorten and lengthen, respectively, until, in the extended position the upper brace 78 will reach an essentially minimum length and the lower brace 80 will reach an essentially maximum length. The first shaft 28 will rotate to allow the manual positioning of the outer post 32 and the arms 18, 46, whereupon the outer post 32 will be brought to the ground 26, and the second shaft 82 will rotate clockwise to allow the angle fge to further increase so that the angle fge will reach its maximum in its extended position. As mentioned earlier, all the time the two locks 106 are unlocked the structure including the outer post 32 will have play. To secure the handrail assembly 10 rigidly now in the operating position, the outer post 32 is positioned so that it is generally vertical in the operating position, and then the two locks 106 are locked. It bears repeating that in the locked position with the outer post 32 engaging the ground, all of the components of the handrail assembly 10 are restrained from moving in any direction, and this point will be taken up again below.

Let us assume now that it is desired to collapse the handrail assembly 10 from the operating position. The two locks 106 are unlocked and the outer post 32 is lifted from the ground upwardly and it is moved rearwardly through the intermediate position of FIG. 2 to the collapsed position of FIG. 1. As the handrail assembly 10 moves from the operating position through the intermediate position to the collapsed position, the upper and lower braces 78 and 80, respectively, will lengthen and shorten, respectively, until, in the collapsed position, the upper brace 78 will again have its maximum length and the lower brace 80 will have its minimum length. The first shaft 28 will rotate freely to allow the angle efg to again attain its relatively large value (e.g., 110° to 14°), and the second shaft 82 will rotate counter-clockwise so as to allow the angle fge to go from its maximum to its minimum amount.

Let us turn now to considering further the freedom of movement of the assembly 10 in the unlocked mode.

Figure 14:
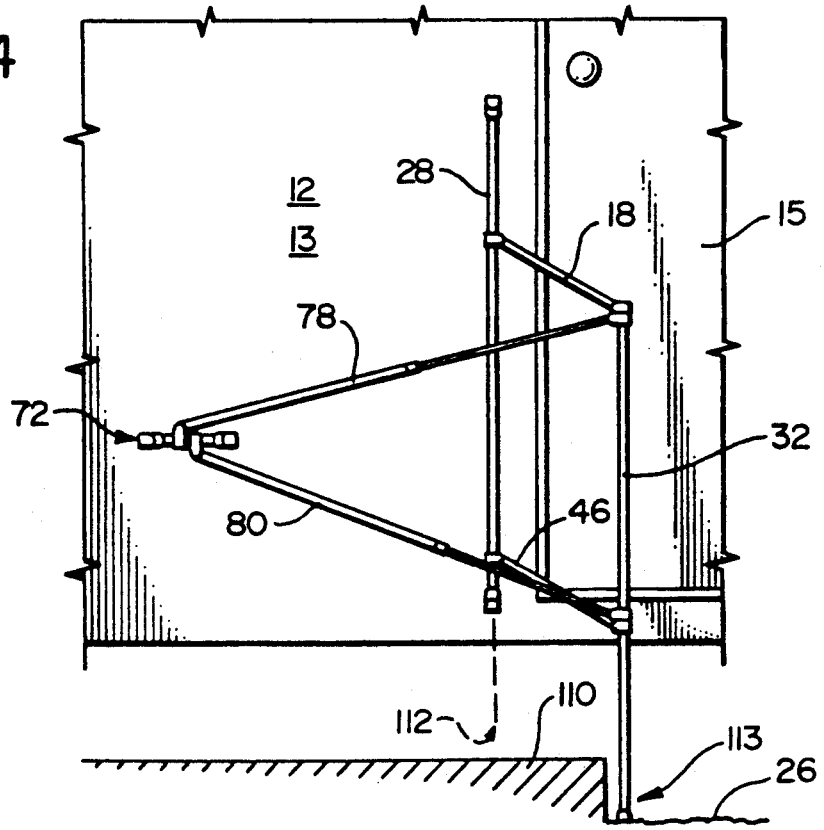
FIG. 14 is a front view showing how the collapsible handrail may be selectively positioned for use, the ground-engaging post of the collapsible handrail being positioned at a selected angular orientation relative to the sidewall in a manner to avoid a masonry obstruction on the ground.

Suppose that it is desired to position the outer post 32 in the operating position, and let us further assume that a masonry block 110 or some other similar obstruction on the ground 26, as shown in FIG. 14, is, positioned in the way so that in the operating position the outer post 32 would be unable to engage the ground 26 at a first location 112. In this case, as the handrail assembly 10 is being moved forwardly from the collapsed position, the free rotatability of the first shaft 28 and the adjustable length capability of the braces 78–80 will enable the post 32 to be positioned at a more convenient second location 113. It is not necessary for the upper arm 18 in the operating position to be positioned perpendicularly to the side wall 12, but instead the outer post 32 and the arms 18, 46 may be positioned at various angular orientations, including the oblique orientation to the side wall 12 indicated in FIG. 14.

Figure 15:
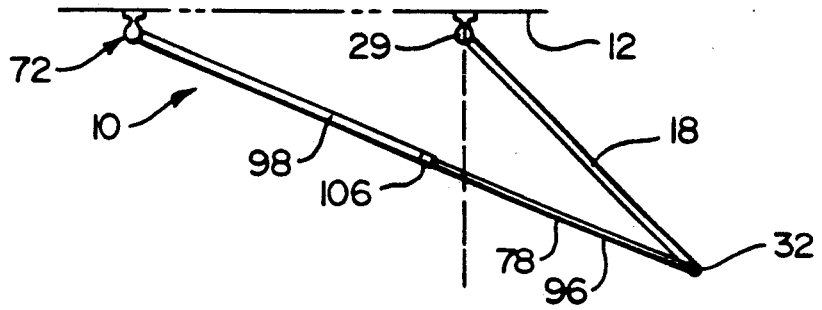
FIG. 15 is a top view of the collapsible handrail wherein the ground-engaging post is positioned upon the ground in a relation to the vehicle at a selected orientation which is at a maximum position rightwardly.
Figure 16:
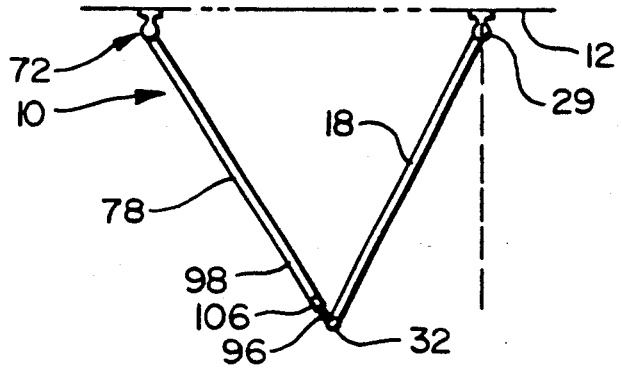
FIG. 16 is a view like FIG. 15, but with the post at location which is an examples of a maximum position leftwardly.

Let us assume that the bottom edge of the doorway 14 has a given height, for example 27 inches, above the ground 26 and let us consider various positions as viewed from above at which the outer post 32 is able to engage the ground. Assuming that the handrail assembly 10 has certain typical dimensions and typical mounting positions to be given presently, in an extreme rightward position which is shown in FIG. 15 under certain conditions the outer post 32 will be able to engage the ground 26 as far to the right of the first shaft 28 as, for example, about 15 to 20 inches, and as far rearwardly to be maximally close to the side wall 12 as, for example, about 20 inches forwardly of the side wall 12, with a limiting factor here being a maximum length capacity (typically perhaps about four feet) of the upper telescoping brace 78. In the position shown in FIG. 3, again based on the typical dimensions the outer post 32 will engage the ground as far forwardly as perhaps about 30 inches forwardly of the side wall 12 (wherein limiting factors here include a typical length of the arms 18 and 46, as for example about 30 inches, and the height assumed to be 27 inches of the doorway 14 above the ground). In an extreme leftward position shown in FIG. 16, under certain circumstances the outer post 32 will be able to engage the ground as far to the left of the shaft 28 as for example about 4-8 inches, wherein a limiting factor is the minimum length capacity of the upper brace 78 (which typically may be about 28 inches.)

"Typical" dimensions and "typical" mounting positions of the assembly 10 may be as follows: The upper and lower arms 18 and 46 as mentioned each may be about 30 inches long; the bottom end of the first shaft preferably is installed so that it touches an extension line 114 (seen in FIG. 1) extending horizontally from the bottom of the doorway 14; the upper arm 18 may be attached to the first shaft 28 at about 29 inches above the extension line 114 (but this is adjustable, as will be explained later); and finally, the anchor fixture 72 might typically be installed on the side wall 12 at one foot above the extension line 114 and approximately 2 feet leftward of the first shaft 28.

Touching briefly now on a feature that permits compact collapsing and stowing, when the handrail assembly 10 is in the collapsed position as seen from the front and from the left side in FIGS. 1, 8, respectively, an outer portion 118 of the lower arm 46 seats snugly to the left of an inner portion 120 of the upper arm 18 which is shown by dashed lines in both figures. The kinked configuration of the lower arm 46 as detailed in FIG. 7 accommodates this overlap so that the unit may be tightly stowed. The kinked area 70 of the lower arm 46, starting with the inner end of the lower arm, is formed by a short straight part 122 which is connected to a short outwardly leftwardly sloped part 124 which is connected to a long outwardly rightwardly sloped part 126 which is connected to the shoe 48 which is attached to the outer post 32.

Figure 10:
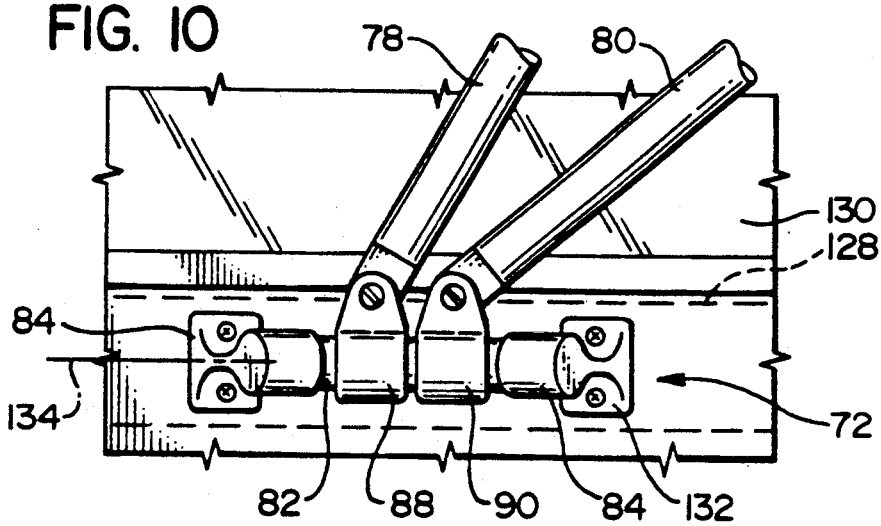
FIG. 10 is a front view illustrating a universal joint fixture which is used to anchor the telescoping braces of the collapsible handrail to the vehicle, with the assembly in the collapsed position and with a shaft of the universal joint fixture mounted so that unlike in FIG. 1 it is oriented horizontally.
Figure 11:
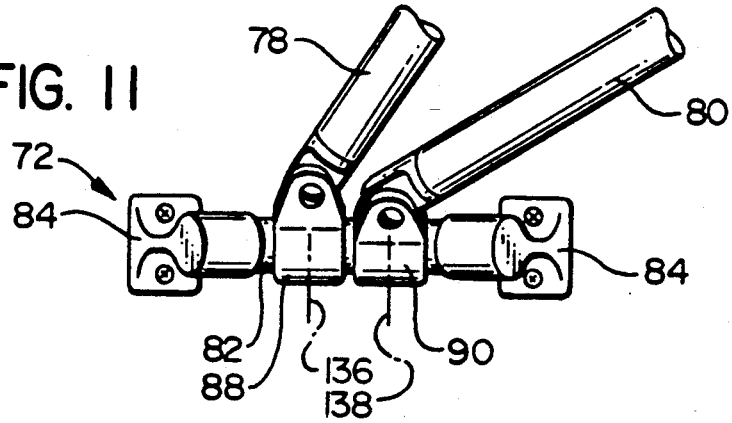
FIG. 11 is a view of the universal joint like FIG. 10 except with the assembly being positioned in the intermediate position.
Figure 12:
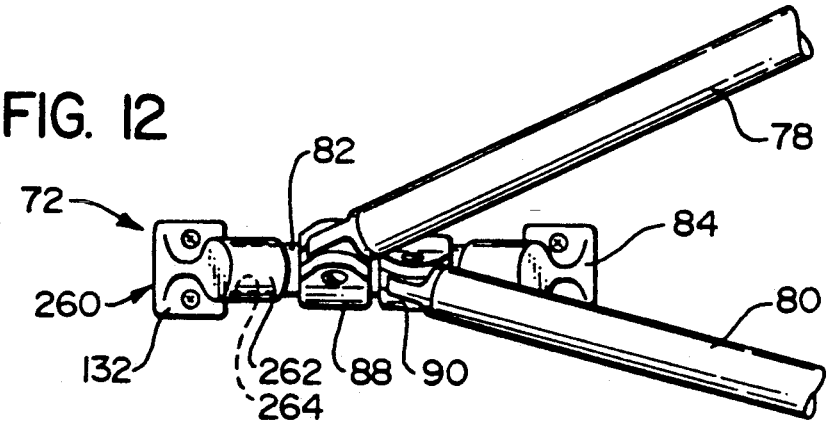
FIG. 12 is a view like FIG. 11 but in the extended position.

Turning next to a capability of the assembly 10 that aids in installation, suppose that in order to locate the anchor fixture 72 in a desired position, it is necessary to fasten the fixture 72 rather than vertically oriented as in FIG. 1, horizontally as in FIGS. 10–12 to a horizontal frame member such as a window-supporting beam 128 that runs beneath a window 130 as shown in FIG. 10. Assuming that the locks 106 of the braces 78–80 are unlocked, the second shaft 82 of the fixture 72 may be turned from the vertical position to the horizontal position so that bases 132 of the mounting fixtures 84 are able conveniently to be fastened to the beam 128. In this horizontal position, the handrail assembly 10 may be collapsed and extended just as before. In the collapsed position shown in FIG. 10, as before, the braces 78, 80 (not shown in full) are at their maximum and minimum lengths, respectively. To extend the assembly 10 from the collapsed position, the procedure is the same as before. The two locks 106 are unlocked and the post 32 is drawn forwardly and downwardly. Again, the braces 78, 80, respectively, shorten and lengthen, however, unlike in the previous examples the second shaft 82 which is now positioned horizontally rotates downwardly to allow the braces 78, 80 to move forwardly and downwardly about a horizontal axis 134 so that the fixture 72 rotates to the intermediate position shown in FIG. 11. Since the upper and lower braces 78, 80, pivot in the shoes 88, 90, as the assembly 10 moves from the collapsed position to the intermediate position, each of the braces 78, 80, respectively, rotates counterclockwise about axes 136, 138 respectively. As the assembly 10 is moved from the intermediate position to the extended position which is shown in FIG. 12, the second shaft 82 and the braces 78, 80 continue to rotate downwardly about the axis 134, while the braces 78 and 80, respectively, continue to shorten and lengthen, respectively, and they are free to pivot. In the extended position the braces 78–80, respectively, are at essentially minimum and maximum lengths, respectively. To collapse the assembly 10 from the operating position of FIG. 12, the process is simply reversed moving the assembly 10 upwardly and rearwardly. It is to be noted that the assembly 10 may operate with the shaft 82 installed at other orientations than vertical or horizontal.

Figure 17:
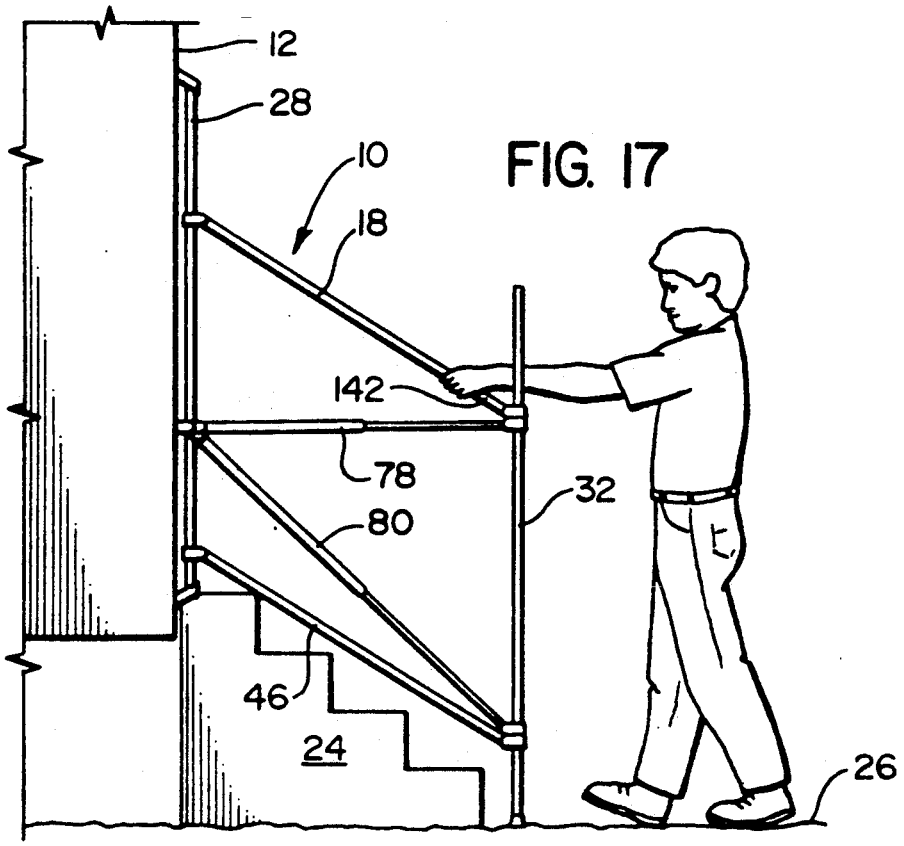
FIG. 17 is a side view of the assembly from the left with telescoping braces omitted for illustration purposes illustrating a manner in which an upper handrail member is positioned at a relatively low level so as to accommodate a short person.

To address the height adjustability of the handrail assembly 10, let it be assumed that the handrail assembly 10 is to be used by a short person such as a child and that it is desired to lower the upper rail 18 to accommodate the user's height. Note that each shoe (34, 36, 48, 50, 88, 90, 92, 94) has a set screw 140 (shown in FIG. 4) that may be tightened or loosened, so that when the set screw 140 is tightened the shoe becomes fixedly attached to its related tubular member (28, 32, 82), and when the set screw 140 is loosened, the shoe may be moved. To determine an appropriate height of the upper arm 18 relative to the user's height, as shown in FIG. 17 the assembly 10 is simply extended with the outer post 32 engaging the ground 26, and then the appropriate set screws 140 are loosened so that the upper arm 18 may be moved and positioned until it is at a location where the user can readily reach an outer end 142 of the upper arm 18 with the person standing on the ground. This procedure is particularly helpful if as shown in FIG. 17 the bottom edge of the door opening 14 is high, as for example 40 inches, above the ground 26. To lower the handrail 18 for the short person, the shoe 36 which is at the inner end of the handrail 18 is lowered on the first shaft 28, and the shoes 34, 94, which are at the outer end of the handrail 18 and the upper telescoping brace 78, are lowered on the outer post 32. Also, by adjusting positions of the other shoes (48, 50, 94), positions of the lower arm 46 and of the lower telescoping brace 80 are adjusted so that the upper and lower arms 18, 46, remain parallel, thereby maintaining the parallelogram 63.

If an unusually tall person is to use the handrail assembly 10, then the same procedure is used as with the short person, except that the upper arm 18 is positioned at a sufficiently high level rather than the lower level so that it is readily reached by the user.

To summarize certain pertinent features of the first embodiment discussed so far, in the operating position when the two locks 106 of the braces 78–80 are locked, an upper triangle 146 as shown in FIG. 3 which is formed by the side wall 12, the upper arm 18, and the upper brace 78, restrains an upper area 148 of the outer post 32 from moving, while a lower triangle 150 formed by the side wall 12, the lower arm 46, and the lower brace 80, restrains a lower area 152 of the outer post 32 from moving. Restraint of the outer post 32 at the upper area 148, at the lower area 152, and at the tip 66 where the outer post 32 engages the ground 26, prevents the post 32 from moving in any direction. A load which may be exerted downwardly on the upper arm 18 is supported at both the inner shaft 28 and the outer post 32, which are rigid. A lateral load on the upper arm 18 is again supported by the inner shaft 28 and the outer post 32 with the rigid lateral support of the locked telescoping braces 78, 80. Since the shoes 34, 36, 48, 50, 92-94, are fixedly attached to the outer post 32 and to the first shaft 28, while the shafts 28, 82, are rotatable and the braces 78–80 and the upper and lower arms 18, 46, are pivotally attached to their respective shoes, the rigidity of the assembly 10 in the operating position is enhanced and while the freedom of movement of the structure in the unlocked mode is allowed. When the locks 106 are unlocked, the parallelogram 63 readily collapses so that the assembly 10 collapses, and the kinked area 70 of the lower arm 46 combined with the rotatability of the second shaft 28 allow the lower arm 46, the post 32, and the upper arm 18, to be packed together compactly. The rotatability of the shafts 28 and 82 enables the outer post 32 in the operating mode to be positioned so as to engage the ground 26 at various distances, heights, and angular orientations, relative to the side wall 12. The anchor fixture 72 may be installed so that the second shaft 82 is oriented as the circumstances require, and the upper arm 18 is height-adjustable, so that it may be used by persons of varying heights.

Figure 18:
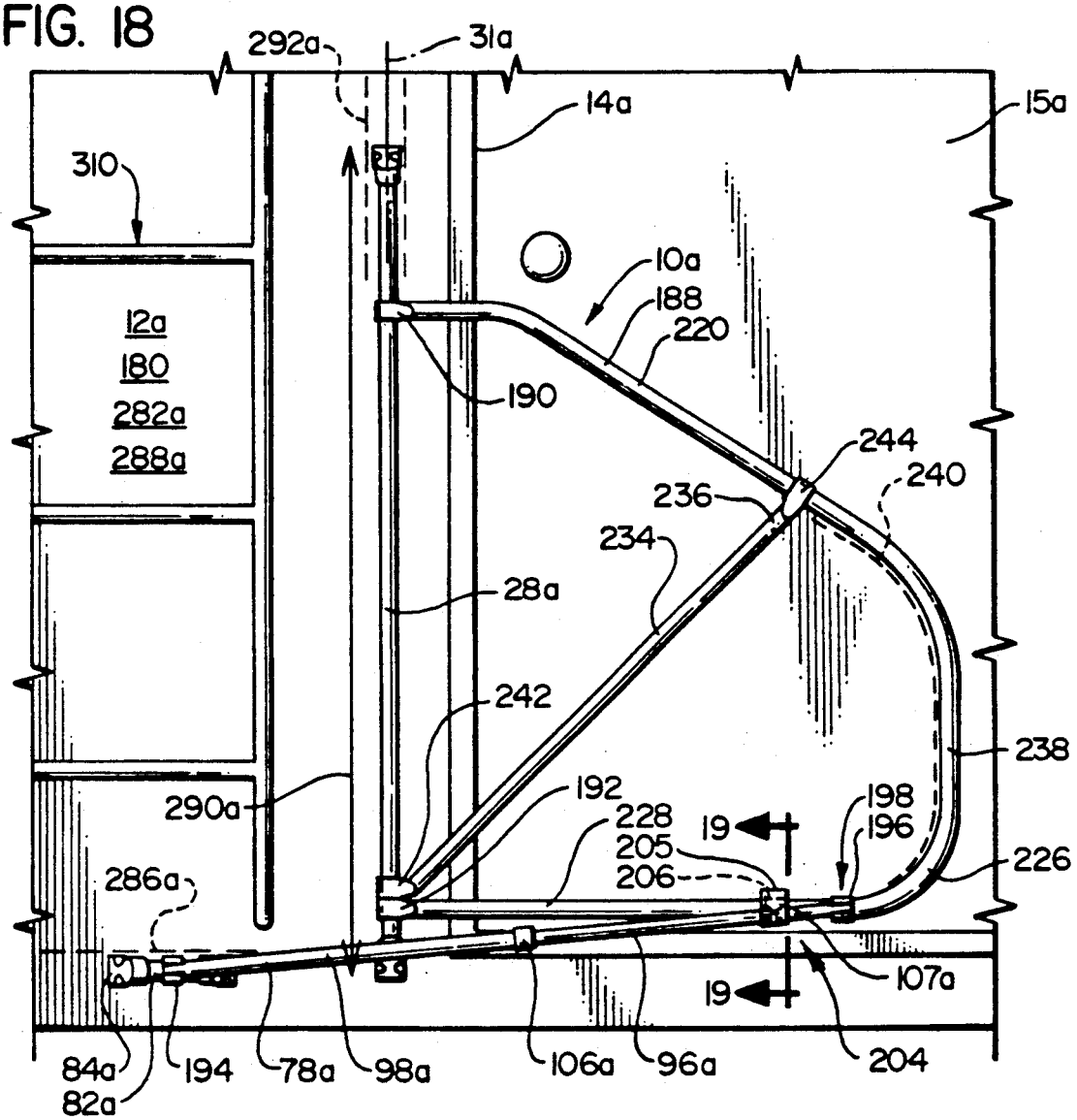
FIG. 18 is a front view of a second embodiment of collapsible handrail assembly of the present invention mounted on a backend of a camper vehicle, with the assembly illustrated in a collapsed position covering a doorway.

Turning now to a second embodiment of the present invention (wherein components that are like components of the first embodiment will have the same numerical designations but with the letter "a" added) as shown in a front view of a handrail assembly 10a in a collapsed position of FIG. 18, there is a first shaft 28a which is mounted vertically adjacent to a side wall 12a of a camper vehicle 180, such as a pickup-truck-mounted camper, for rotation about a vertical axis 31a to a left side of a doorway 14a. Attached fixedly to the first shaft 28a, there is a looped member 188, an upper end of which is attached to a shoe 190 which is fixedly attached to an upper portion of the shaft 28a, with a lower end of the looped member 188 being attached to a shoe 192 that is fixedly attached to a lower portion of the shaft 28a, and with the looped member 188 thereby being pivotable in a horizontal direction about the vertical axis 31. A telescoping brace member 78a has an inner end pivotally attached to a shoe 194 which is in turn fixedly attached to a shaft 82a that is mounted at its two end to the side wall 12a in mounting fixtures 84a for rotation. An outer end of the brace 78a is connected pivotally to a shoe 196 that is fixedly attached at 198 to an outer lower area of the looped member 188. The brace 78a pivots at its inner end in the shoe 194, and pivots at an outer end thereof in the shoe 196. The brace 78a comprises an inner shaft 96a which is slideably engaged in an outer sleeve 98a, with a screw lock 106a provided so that when the lock 106a is locked the shaft 96a is restrained from moving relative to the sleeve 98a and so that when the lock 106a is unlocked the shaft 96a may move freely relative to the sleeve 98a.

Figure 20:
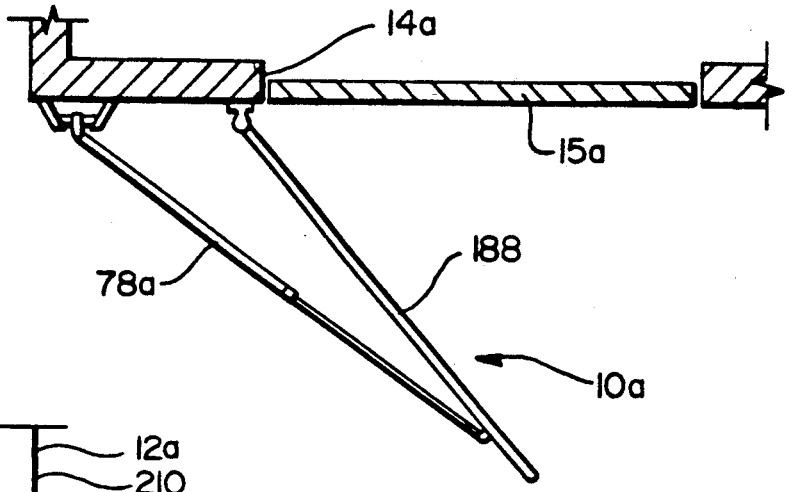
FIG. 20 is a top view of the second embodiment of the collapsible handrail positioned in an intermediate position.
Figure 21:
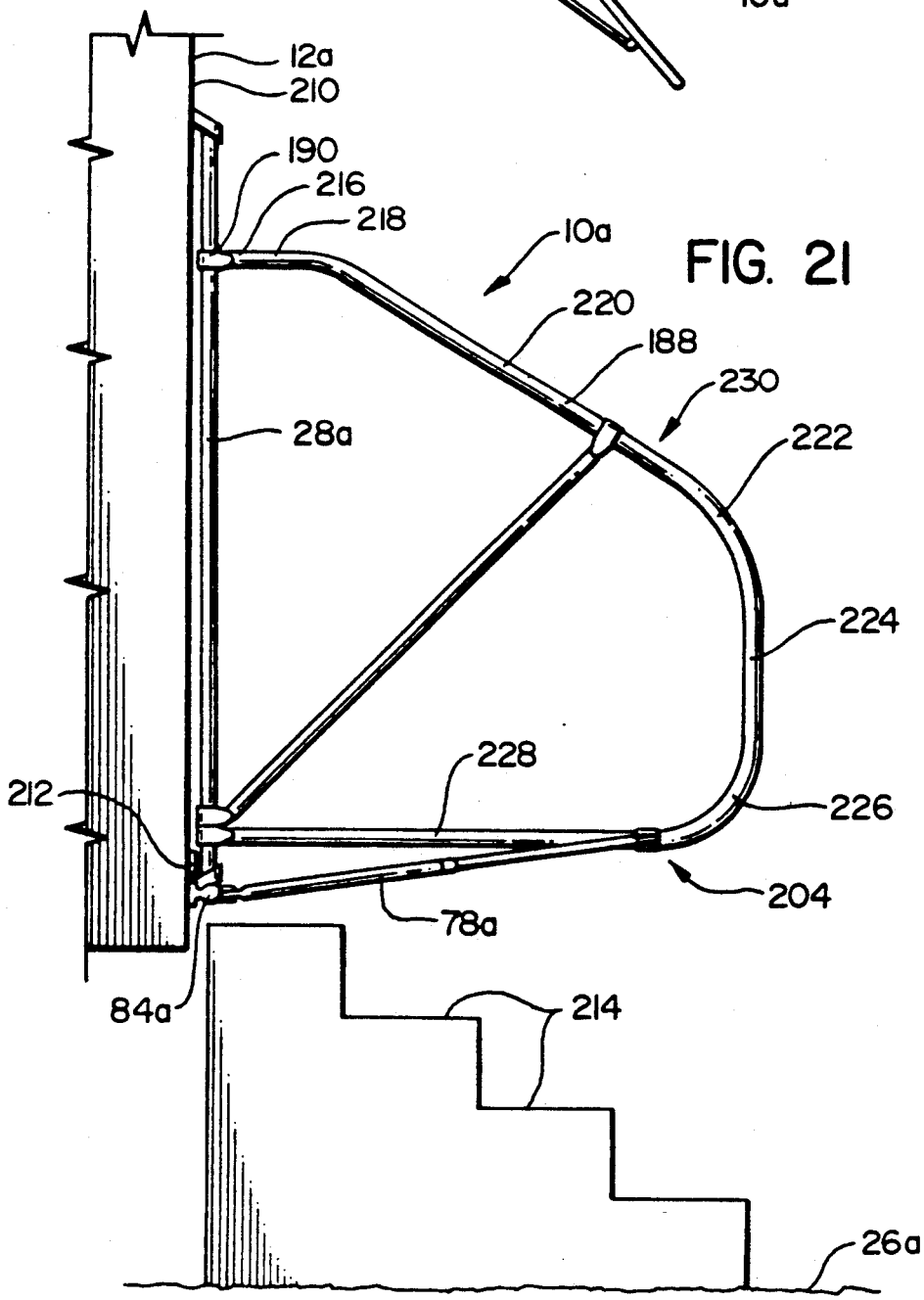
FIG. 21 is a left side view of the collapsible handrail of the second embodiment in an extended or operating position used on a type of a pickup-truck and camper vehicle combination that is relatively low to the ground.

Let us consider the looped member 188 and the telescoping brace 78a (which together constitute a collapsible assembly 204) in the collapsed position shown in FIG. 18, wherein the telescoping brace 78a is at its maximum length. The looped member is positioned where it extends rightwardly to cover the doorway 14a, and the brace 78a is locked by tightening the lock 106a. A clasp 205 that is mounted to the side wall 12a receives a portion 206 (indicated by hidden lines) of the looped member 188 within a notch 207, as shown in the cross-sectional view of FIG. 19, and a strap 107a is provided which fastens around the portion 206 so as to hold the looped member in place in the collapsed position. Assuming that it is desired to extend the collapsible assembly 204 from the collapsed position, the strap 107a is unfastened, the lock 106a is unlocked, and the looped member 188 is then rotated forwardly. As the collapsible assembly 204 moves from the collapsed position through an intermediate position shown in a top view of FIG. 20 the brace 78a shortens. The looped member 188 is further rotated until it is in a position where it is able to be conveniently reached by the user, as shown in FIG. 21, whereupon the collapsible assembly 204 is locked in place by locking the lock 106a. While in the picture the looped member is shown perpendicular to the side wall 12, the looped member may be locked at any convenient angular position relative to the side wall 12a.

Let us now assume as shown in FIG. 21 that the handrail assembly 10a is mounted to a relatively low camper vehicle 210 wherein the bottom of the doorway 14a is relatively low, as for example about 32 inches above the ground 26, so that a person who is exiting a doorway 14a needs to use a threshold 212 and four steps 214 in order to descend to the ground 26a. Starting at 216 where the upper side of the looped member connects to the shaft 28a, the looped member has a short upper horizontal portion 218 which connects to an outwardly, downwardly slanted portion 220. The person will begin to exit through the door opening 14a and initially will hold onto the upper horizontal portion 218. This will provide the person initial orientation so that the person can sense by touch that the person's hand is at the top of the looped member. As the person descends the steps 214, the slanted portion 220 will provide a firm support for the person to grip, which will enable the person to safely reach the ground 26*a*.

Now let it be assumed that the person wants to ascend the steps 214 and that the person is short. The shape of the looped member 188 accommodates a short person. The looped member 188 has the horizontal and slanted portions 218, 220, which in turn are connected to a curved upper shoulder 222 which is connected to a straight vertical portion 224 which is connected to a curved lower shoulder 226 which is connected to a lower horizontal portion 228 that is connected through the shoe 192 to the first shaft 28*a*. The slanted portion 220, upper shoulder 222, vertical portion 224, lower portion 226, and lower horizontal portion 228, together constitute a handgrip 230 any part of which the person may grab onto in order to start the person's ascent from the ground position. Climbing up further, the person then may grab onto the slanted portion 220 and finally the upper horizontal portion 218 so that the person may enter the doorway 14*a*. A tall person ascending the steps 216 might grab immediately onto the slanted portion 220 and then, as the person ascends, the upper horizontal portion 218, so that the person is able to reach the doorway 14*a*.

Figure 22:
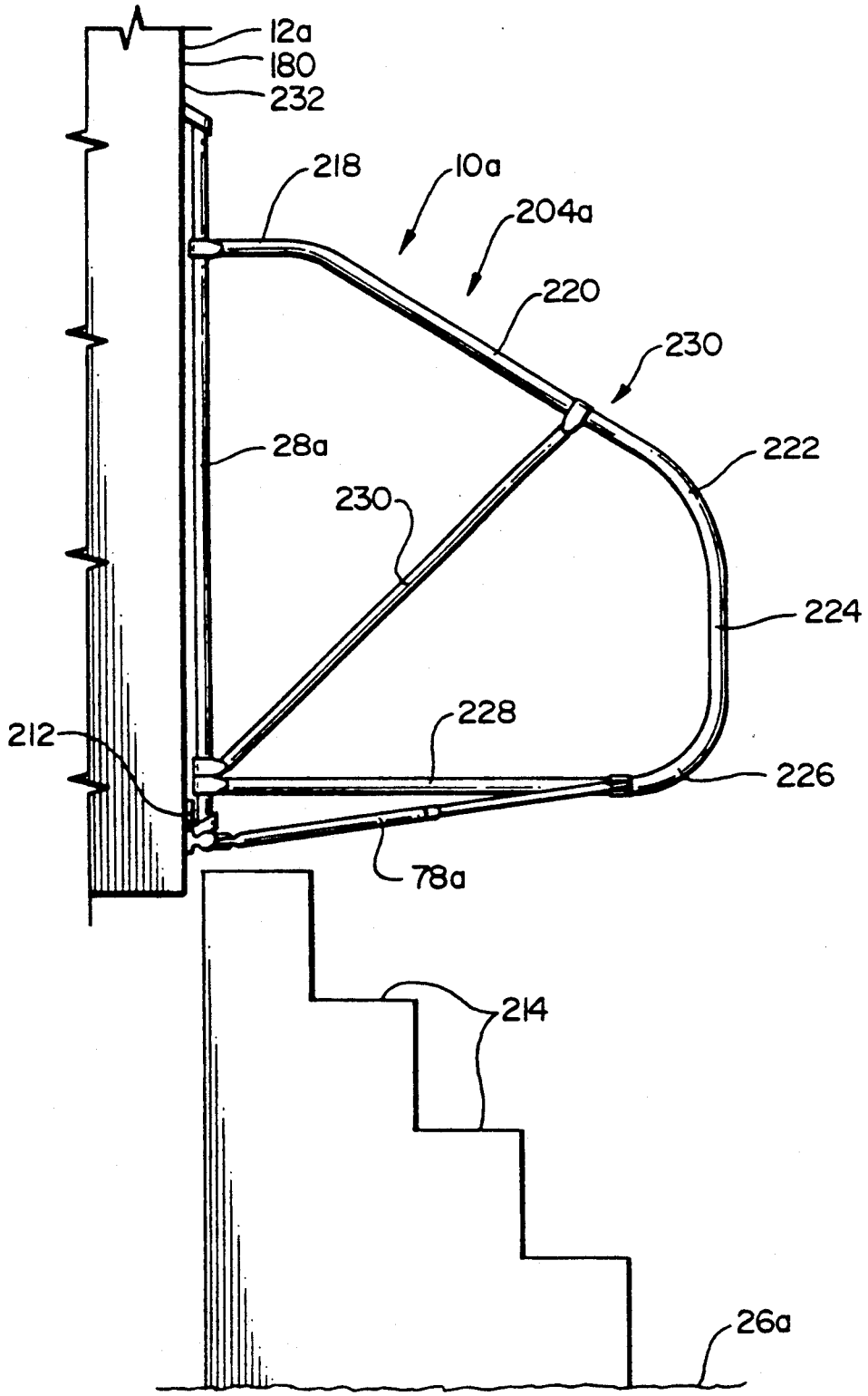
FIG. 22 is a view like FIG. 21 except that the combination of pickup-truck and camper vehicle is a type that is relatively high above the ground.

Now let it be assumed that the assembly 10*a* is mounted to a high camper vehicle 232 as shown in FIG. 22 with the doorway 14*a* at a relatively high level, as for example about 45 inches above the ground 26*a*. A person exiting the doorway 14*a* in this case must use the threshold 212 and typically five of the steps 214 to descend to the ground 26*a*. If the person is short then the person will probably begin the descent by holding onto the upper horizontal portion 218, which again will help to orient the person, and then holding onto the slanted portion 220, or to a diagonal brace 234, or any part of the handgrip portion 230 so that the person has a continuous handgrip support until the person reaches the ground 26*a*. The person may reach above the person's shoulder, or even overhead, to hold onto the handgrip 230. A taller person may be able to make it to the ground 26*a* using just the upper horizontal portion 218 and the slanted portion 220. A person who wants to ascend the steps 214 in FIG. 22 may begin by gripping onto any part of the handgrip portion 230, using the assembly 10*a* as described before to reach the doorway 14. It is to be noted that the steps 214 offered by typical manufacturers for various heights of camper vehicles, including both the low camper vehicle (FIG. 21) and the high camper vehicle 232 (FIG. 22), typically extend out generally from the rear of the camper about the same distance, as for example perhaps about 25 to 35 inches. The handrail assembly 10*a* preferably will generally match this outward, projection distance, by having an outward projection distance in a fully extended position of about 30 inches.

The diagonal brace 234, which was mentioned in the previous paragraph is designed to add strength to the assembly 10*a* and to provide the described additional handhold. The diagonal brace 234 is rigidly connected between a lower part of the first shaft 28*a* and a middle part of the slanted portion 220 of the looped member 188.

It is to be noted that in the collapsed position the collapsible assembly 204 keeps the door 15*a* of the camper vehicle 180 securely closed so as to prevent accidental opening of the door 15*a* during the operation of the vehicle 180. However, if a person, such as a partially infirm person, is a passenger riding in the camper vehicle 180, then the handrail assembly 10*a* should be kept positioned in the operating position, i.e., extended and locked, so that if the person must make an exit from the vehicle, the assembly 10 will allow the person to open the door 15*a* and to descend using the assembly 10*a*.

The present invention may be positioned and used alongside doorways of various structures other than vehicles, such as buildings, where the same problems that require using a collapsible handrail with a vehicle exist.

Having described the basic details of the invention, further technical details will now be provided. These details will involve the following: 1. Positions of the shoes of the first and second embodiments; 2. connecting and mounting fixtures; 3. certain angular relationships among braces and arms of the first embodiment; 4. positioning of the claps; 5. installation of the handrail assemblies of the first and second embodiments.

1. Positions of Shoes

Generally it is desirable for the shoe 92 of the first embodiment (which is connected to the outer end of the upper telescoping brace 78 and located on the outer post 32), to be positioned underneath, rather then above, the shoe 34 (which is connected to the upper arm 18). This way, when the person slides the person's hand downwardly and outwardly along the upper arm 18, the upper arm 18 is unobstructed. It is preferable that the shoes 88, 90 at the inner ends of the two telescoping braces 78, 80 be rigidly fixed to (that is, with their set screws 140 tightened so as to clamp) the second shaft 83; it is also preferable that the shoes 88, 90 abut one another, as shown for example in FIGS. 10-12, so that the shoes 88, 90 will provide rigid support for the braces 78, 80, which will rigidly support the handrail 18 against lateral loads. However, obviously the second shaft 82 may be modified to be lengthened and the shoes 88, 90 may be spaced from one another. Looking at the shoes that are attached to the outer post 32 in FIG. 3, it is preferable that the shoe 92 abut the shoe 34 from underneath so as to provide additionally vertical support for the handrail 18, and for the shoe 48 to directly abut the shoe 94. Again, obviously any of these shoes may be positioned so as to be spaced from one or more of the other shoes.

In the second embodiment as shown in FIG. 18, the diagonal brace 234, as mentioned, is rigidly attached to the first shaft 28*a*. The diagonal brace 234 is designed to slope upwardly and outwardly to a location 236 where the brace 234 attaches to a middle portion of the outwardly downwardly slanted portion 220 of the looped member 188 so that the diagonal brace 234 and an outer portion 238 (highlighted by an adjacent dotted line) 240 of the looped member 188 cooperate to form an arch which supports and distributes a downward load applied to the slanted portion 220. Preferably a shoe 242 through which the diagonal brace 234 rigidly attaches to the first shaft 28*a* abuts on top of the shoe 192 (which rigidly connects the first shaft 28*a* to the bottom end of the looped member 188). Also it is preferable that the shoe 194 through which the telescoping brace 78*a* connects to the second shaft 82*a* have a rigid connection to the shaft 82*a*.

It is to be noted that the location 198 where the outer end of the telescoping brace 78*a* connects to the looped member 188 is approximately where the lower horizontal portion 228 meets the curved lower shoulder 226 of the looped member 188. This location is far enough outwardly, typically about 20 inches from the first shaft 28*a* to provide ample leverage for rigid support of the looped member 188 and provide a convenient place for the shoe 196 to seat rigidly to the looped member 188.

Figure 4:
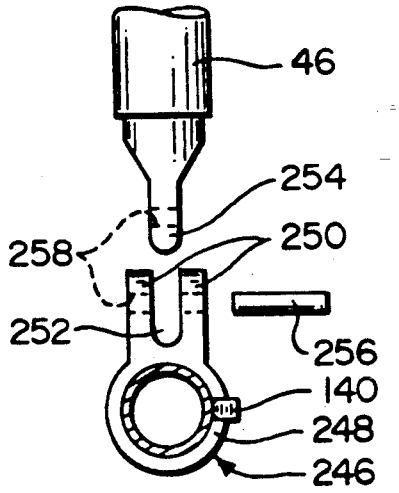
FIG. 4 is a cross-section taken along the line 4—4 in FIG. 3 of one of the fixtures used to interconnect the tube members of the assembly.

The shoes of the first and second embodiments, that is shoes 34, 36, 48, 50, 88, 90, 92, 94, 190, 192, 194, 196, 242, 244, are each illustrated as a generic shoe fixture 246 as shown in the cross-section of FIG. 4 having a hollow cylindrical portion 248 which is connected to one end thereof to a pair of jaws 250 which are parallel and which define a tongue-receiving slot 252. Each end of each tubular arm, brace or looped member (18, 46, 71, 78*a*, 80, 188, 234) has a tongue 254 which is inserted in the slot 252 so that a pin 256 is then able to be engaged through bores 258 (shown by hidden lines) through the jaws 250 and through the tongue 254 so as to pivotally connect the arm, brace, or looped member to the shoe 246.

2. Connection and mounting fixtures

The mounting fixtures 29, 29*a*, 30, 30*a*, 84, 84*a* are each a generic mounting fixture 260 (as shown on the left side of FIG. 12) which comprises a head 262 which is connected to the base 132 previously mentioned. There is a hollow cylindrical bore or well 264 shown by hidden lines within the head 262 which receives an end of the various shafts 28, 28*a* 82, and 82*a*.

The locks 106 and 106*a* preferably are positioned on their respective braces 78, 78*a*, 80 in a manner that a thumbscrew 266 of the locks 106, 106*a* (as shown in FIG. 1), is positioned generally upright, so that when the vehicle 13, 180, is in motion and the handrail assemblies 10, 10*a*, are subjected to vibration, the screws 266 are more likely to avoid falling loose from the locks 106, 106*a*.

3. Angular Relationships

Figure 5:
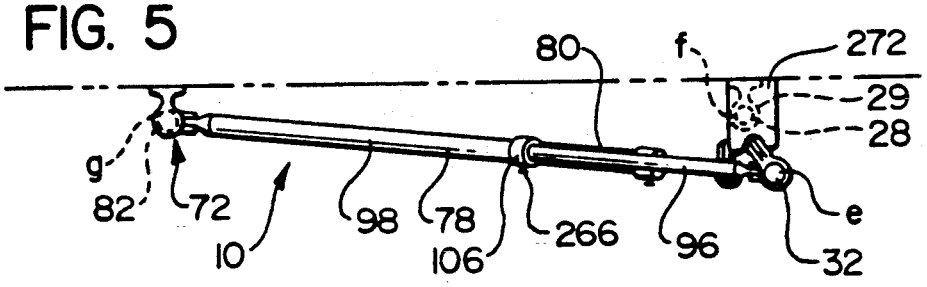
FIG. 5 is a top view of the collapsible handrail in the collapsed position.
Figure 6:
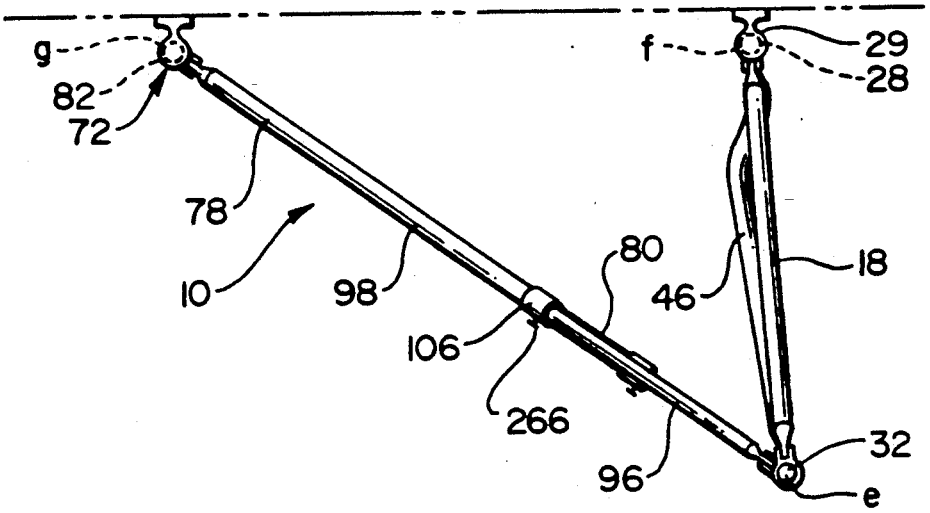
FIG. 6 is a view like FIG. 5, but with the collapsible handrail in the intermediate position.
Figure 7:
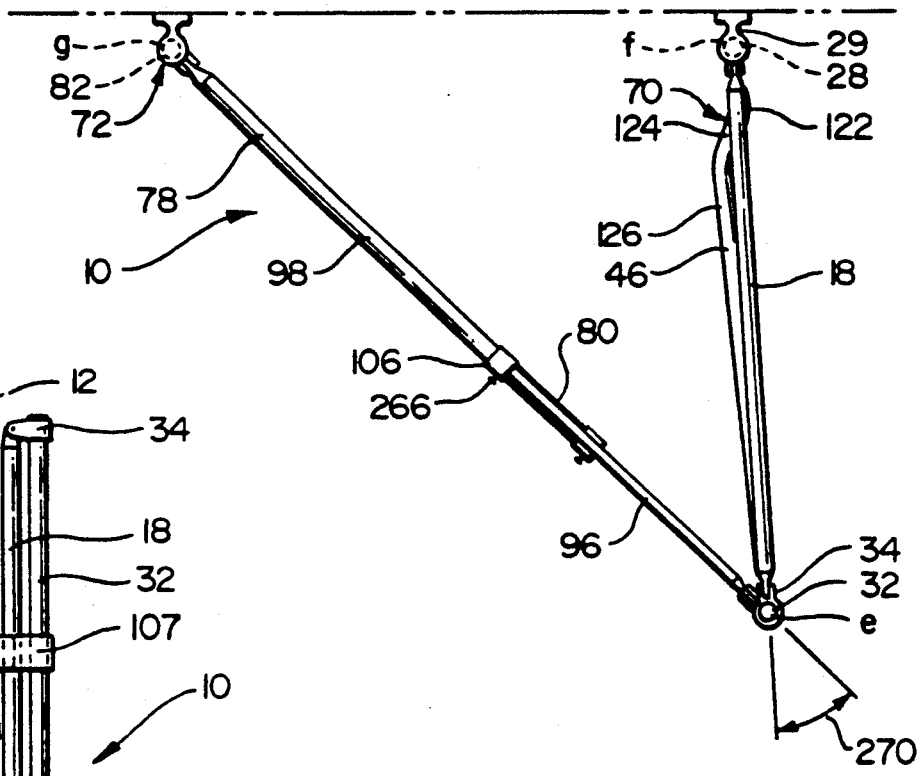
FIG. 7 is a view like FIG. 6 but with the assembly in the operating position.

During the extending and collapsing movements of the handrail assembly 10 of the first embodiment, there is a triangular relationship between the outer post 32, the first shaft 28, and the second shaft 82, such that angles efg, fge, and gef as seen from the top in FIGS. 5 through 7 sum to 180°. Inasmuch as the shoes 34, 48, 92, 94, that are pivotally attached to outer ends of the upper arm 18, lower arm 46, upper telescoping brace 78, and lower telescoping brace 80, are each rigidly attached to the outer post 32, the angle gef which the upper arm 18 makes with the upper telescoping brace 78, and an angle 270 (shown at the bottom of FIG. 7) which the lower arm 46 makes with the lower telescoping brace 80, throughout the extending and collapsing of the assembly 10 both generally are constant. A consequence of this is that the first and second shafts 28, 82, both must rotate to accommodate these constant angles gef, 270. Typically the angle gef is perhaps about 45° and the angle 270 is slightly less than that (since, as mentioned, the lower arm 46 is kinked at 70), although these angles are adjustable merely by loosening and repositioning the shoes 34, 48, 92, 94. (As seen in FIG. 7, the shoes 34, 36, at the two ends of the upper arm 18 keep the upper arm 18 generally centered on the line ef through the outer post 32 and the first shaft 28. This alignment of the upper arm 18 is maintained as the assembly 10 moves from the extended position of FIG. 7 to the intermediate position Of FIG. 6. However, as the assembly 10 moves to the collapsed position of FIG. 5, the alignment just described is not strictly maintained because there is some play in the structure so that the upper arm 18 now aligned vertically has a tendency to seat rightwardly of the line ef. This is due in part to the fact that the kink 70 allows the lower arm 46, and the upper arm 18 to seat alongside one another as explained in connection with FIG. 8.) In the illustrated extended position of FIG. 7, the angle gef has its constant value (45°), the angle efg is selectively positioned at 90°, and accordingly, the angle fge, which as earlier mentioned is at its maximum, has an appropriate value so that the angles sum to 180° (45°). When the assembly 10 is in the illustrated intermediate position of FIG. 6, the angle gef has its generally constant value (45°) the angle efg is increased to an intermediate value (100°), and the angle fge has an appropriate value so that the angles sum to 180° (35°). When the assembly 10 has reached the illustrated collapsed position of FIG. 5, the angle gef (perhaps now 40°), is somewhat (perhaps 5°) less than its constant value, because, as mentioned, the upper arm 18 has swung rightwardly of the line ef, while the angle efg is increased to its large value (let us assume 130°) while the angle fge has a value (10°) appropriate to make the angle sum to 180°.

4. Clasps

The upper arm 18 of the handrail assembly 10 of the first embodiment is received in a clasp 272 which is mounted to the side wall 12 in a position upwardly of the upper end of the first shaft 28. As mentioned previously the assembly 10 is held in place in the collapsed position by the straps 107 (shown in an open position in FIG. 3), which are made of a self adhering material, like that marketed under the name Velcro, and which are wrapped from the left and the right sides of the clasp 272 so as to fasten around an outer side of the outer post 32. It is to be noted as shown in FIG. 3, that the clasp 272 comprises left and right projections 274 which define a notch 276 which receives the upper arm 18 when the assembly 10 is moved to the collapsed position. The clasp 272 preferably is positioned on the side wall 12 in a manner that in the collapsed position the notch 276 holds the upper arm 18 vertically disposed and slightly rightward relative to the first shaft 28 as seen in FIG. 5.

The strap 107 is a single pice of material (comprising, as mentioned, Velcro or the like which attaches to itself) is positioned on the side wall 12 as shown in FIG. 3 and the clasp 272 is positioned over the strap 107 in the manner shown, with the notch 276 positioned to receive the upper arm 18 as previously described.

Figure 19:
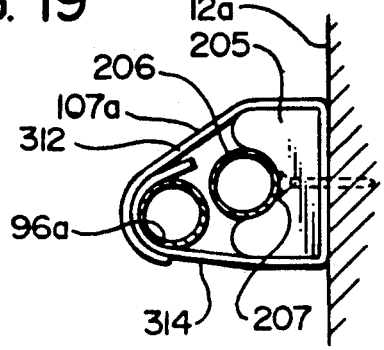
FIG. 19 is a cross-section of a clasp taken along a line 19—19 in FIG. 18.

The handrail assembly 10*a* of the second embodiment also uses the clasp 205 (similar to the clasp 272 of the first embodiment) as shown in the cross section of FIG. 19, wherein the notch 207 (similar to the notch 276 of the first embodiment) receives the portion 206 of the looped member 188 as previously mentioned. In this case, the straps 107*a* wrap around both the looped portion 188 and the telescoping brace 78*a* to secure the assembly 10*a* in the collapsed position.

Assuming that the right side of the recreational vehicle 13 of FIG. 3, is also the front of the vehicle 13, and that when the vehicle 13, is moving there is wind due to such movement which blows from the right to the left, desirably the strap 107 will comprise a left short portion 278 and a right long portion 279. In the collapsed position of FIG. 1, the short portion 278 is first folded from the left over the collapsed tubular members (18, 32, 46), and then the right long portion 279 is folded from the right over the front of the short portion 278. This prevents the wind from unfastening the strap 107 during travel. rightward relative to the first shaft 28 as seen in FIG. 5.

The strap 107 is a single pice of material (comprising, as mentioned, Velcro or the like which attaches to itself) is positioned on the side wall 12 as shown in FIG. 3 and the clasp 272 is positioned over the strap 107 in the manner shown, with the notch 276 positioned to receive the upper arm 18 as previously described.

The handrail assembly 10*a* of the second embodiment also uses the clasp 205 (similar to the clasp 272 of the first embodiment) as shown in the cross section of FIG. 19, wherein the notch 207 (similar to the notch 276 of the first embodiment) receives the portion 206 of the looped member 188 as previously mentioned. In this case, the straps 107*a* wrap around both the looped portion 188 and the telescoping brace 78*a* to secure the assembly 10*a* in the collapsed position.

Assuming that the right side of the recreational vehicle 13 of FIG. 3, is also the front of the vehicle 13, and that when the vehicle 13, is moving there is wind due to such movement which blows from the right to the left, desirably the strap 107 will comprise a left short portion 278 and a right long portion 279. In the collapsed position of FIG. 1, the short portion 278 is first folded from the left over the collapsed tubular members (18, 32, 46), and then the right long portion 279 is folded from the right over the front of the short portion 278. This prevents the wind from unfastening the strap 107 during travel. fixture 72 is then tentatively located adjacent to a stud 294 which is sufficiently leftward of the first shaft 28 to give the braces 78, 80 a substantial lateral component for lateral support of the assembly 10. A limitation, which may be tested by tentatively fastening the fixture 72 to the side wall 12 and then moving the assembly 10 between the operating position and the collapsed position, will be that the fixture 72 must be positioned where during the movement of the assembly 10, neither the minimum capacity length of the braces 78, 80, nor the maximum capacity length of the braces 78, 80 is reached, so that the braces 78, 80 allow optimum freedom of movement and remain intact. Even with this requirement the fixture 72 may be positioned at a wide range of positions laterally and above and below the bottom of the doorway 14. For example, under certain conditions and given the typical dimensions provided earlier, the fixture 72 may be positioned about 15–30 inches leftward of the imaginary vertical line 76 (aligned with the first shaft 28). Once the final desired position of the fixture 72 is ascertained, each of the mounting fixtures 29, 30, 84, is firmly fastened through the sheath 288 into the underlying frame (284, 286).

Figure 9:
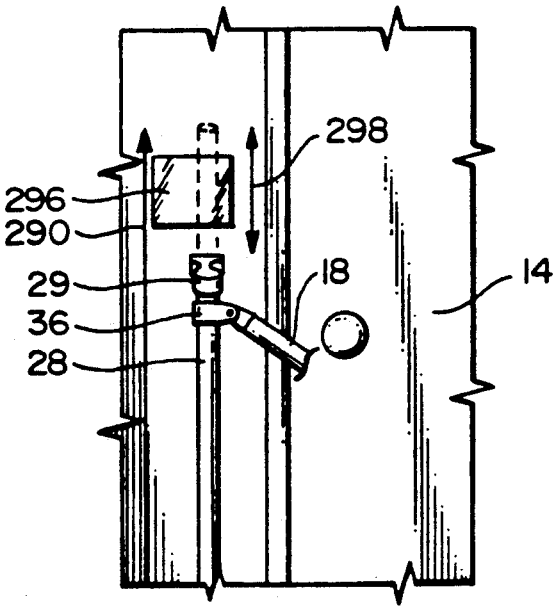
FIG. 9 is a front view showing how an inner shaft of the collapsible handrail which is mounted to the vehicle may be cut in height so as to fit beneath a light bulb fixture located on the vehicle.

Suppose that a light bulb fixture or other obstruction 296 is located on the side wall 12 adjacent the left side of the doorway 14 in a manner to interfere with the positioning of the upper mounting fixture 29 of the first shaft 28 as just described. As shown in FIG. 9 the uncut height (indicated by the arrow 290) of the first shaft 28 is sufficient to allow the upper arm 18 to be positioned high enough above the bottom of the doorway 14 for use by most tall people, and the uncut height is also sufficient to provide a supplemental height (indicated by the double-headed arrow 298) which allows the first shaft 28 to be cut down selectively in height so that the upper mounting fixture 29 may be selectively positioned to avoid the obstruction 296.

Figure 13:
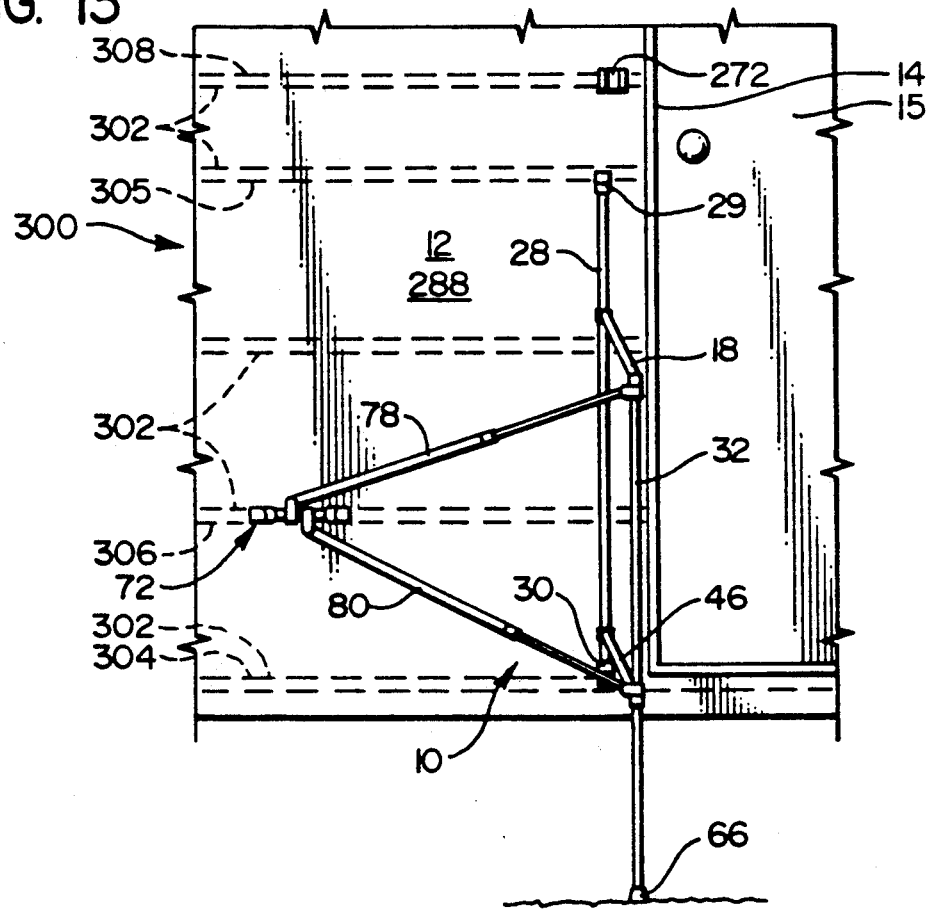
FIG. 13 is a schematic front view showing the manner in which the collapsible handrail is mounted to a wall that has an underlying frame consisting of horizontal members.

Suppose that it is desired to install the handrail assembly 10 to a horizontal-bar-supported version 300 of the side wall 12 as shown in FIG. 13. (which is sometimes encountered in metal framed recreational vehicles). In the horizontal-bar-supported version 300, a plurality of horizontal bars 302 form the underlying frame which supports the sheath 288 of the side wall 12. In this case, any vertical stud which may be sufficient to provide a purchase for fastening the assembly 10 alongside the doorway 14 is absent. The lower mounting fixture 30 alone is first positioned adjacent to the lefthand lower corner of the doorway 14 where the base 132 of the fixture 30 may be tentatively fastened to a presumably existing horizontal bar 304 which underlies and supports a threshold of the doorway 14. An appropriate length of the first shaft 28 is determined such that there will be ample length to position the upper arm 18 sufficiently high for the user and such that the upper mounting fixture 29 of the first shaft 28 may be positioned adjacent to the left side of the doorway 14 at a location where the fixture 29 may attach through the sheath 288 to a bar 305 which is at an upper location. After the first shaft 28 is cut to this appropriate length, a lower end of the first shaft 28, (with the assembly 10 essentially assembled now) is inserted in the lower mounting fixture 30 on the side wall 12 and the upper mounting fixture 29 which is attached to the shaft 28 is then fastened at the previously determined location to the horizontal bar 305. With the locks 106 unlocked, the anchor fixture 72 is then tentatively attached leftward of the first shaft 28 to a horizontal bar 306 so that the assembly 10 is provided with the substantial lateral support component and so that the free movements of the assembly 10 (as indicated above in connection with the vertical-stud-supported version installation) is able to be tested by moving the assembly 10 between the operating position and the collapsed position. The strap 107 and clasp 272 are mounted attached to a horizontal bar 308 above the upper mounting fixture 29 where the notch 276 is positioned as previously described to receive the upper arm 18 in the collapsed position. With the horizontal-bar-frame version 300, the anchor fixture 72 is installed with the second shaft 82 oriented horizontally (as in FIG. 10–12).

Let it be assumed that it is desired to install the handrail assembly 10*a* of the second embodiment on a vertical-stud-supported version 282*a* of the side wall 12*a* as shown in FIG. 18, and let it be further assumed that a stud 292*a* is positioned adjacent to the left side of the door opening 14*a* and underneath the sheath 288*a*. In this case, with the assembly 10*a* being essentially preassembled the first shaft 28*a* is used at its full height, i.e., the uncut height indicated by the arrow 290*a*, and is simply positioned in alignment with the stud 298*a* with the lower mounting fixture 30*a* being positioned at the lower lefthand corner of the doorway 14*a* where it is tentatively fastened to the sheath 288*a* to a horizontal frame member 286*a* and with the upper mounting fixture 29*a* fastened through the sheath 288*a* at an upper location to the stud 292*a*. With the lock 106*a* of the telescoping brace 78*a* unlocked the anchor fixture 72*a* is then tentatively fastened to the horizontal frame member 286*a* at a location leftward of the first shaft 28*a* so as to provide a substantial lateral support component for the assembly 10*a* and so that the assembly 10*a* may be moved between the collapsed position and the extended position to test for freedom of movement of the brace 78*a*. As in the first embodiment, the positioning of the anchor fixture 72*a* depends upon the minimum and maximum extension capacity of the brace 78*a*. Typically the rear of the camper vehicle 180, where as mentioned the assembly 10*a* is mounted, provides little working width (perhaps 1, 2, or 3 feet), and there also may be an obstruction such as a ladder 310, leftward of the door 14*a*. To cope with the small working width, it is desirable to use a brace 78*a* that has a short minimum length capacity (perhaps 20 inches) which is shorter than that of the telescoping brace 78, 80 of the first embodiment. The anchor 72*a* must be positioned so that during the movement of the assembly 10*a* the ladder 310 does not interfere with the movement of the brace 78*a*. While the lock 106*a* is still unlocked, the shoe 196 (pivotally attached at the outer end of the brace 78*a*) which heretofore has been loosely positioned (i.e., with the set screw 140 unclamped) on the lower horizontal portion of the looped member 188 should now be positioned at 198 at the outer end of the lower horizontal portion 228 and positioned at an angular position in relation to the lower horizontal portion 228 so that the telescoping brace 78*a* may freely pivot during the movement of assembly 10*a*, with the shoe 196 then being clamped in this position by tightening the set screw 140*a* when the proper positions are determined, the mounting fixtures 29*a*, 30*a*, 84*a*, are firmly fastened to their respective frame members 286*a*, 292*a*, and the strap 107*a* which is a single piece of self adhering material like Velcro, and the clasp 205 on top of the strap 107*a* is mounted where the notch 207 is able to comfortably receive the lower horizontal position 228 of the looped member 188. Whereas typically the strap 107*a* is divided into a longer side 312 and a shorter side 314, it may be desirable to position the longer side 312 at the top and the shorter side 314 at the bottom so that gravity aids in keeping the strap 107*a* in place in the collapsed position.

It is to be noted that as in the first embodiment, the brace 78*a* and anchor fixture 72*a* are operable with the anchor fixture 72*a* positioned at various angular orientations other than horizontal. Thus, for example, the anchor fixture 72*a* could be installed with the fixture 72*a* oriented vertically.

Let is be assumed instead that the assembly 10*a* of the second embodiment is to be installed to a horizontal-bar-supported version 162*a* of the side wall 12*a*. In this case, which is not pictured, the procedure is generally the same as with the first embodiment. The shaft 28*a* is positioned adjacent to the left side of the doorway 14*a*, with the lower mounting fixture 30*a* being positioned near to the bottom of the door opening 14*a* and attached though the sheath 288*a* to a bar 302*a* that frames the bottom of the doorway 14*a* and extends leftwardly therefrom. The shaft 28*a* is cut to a height which enables the upper fixture 29*a* to be positioned adjacent to the door opening 14*a* and to be attached through the sheath 288*a* to an underlying horizontal bar 302*a* at an upper location. Unlike in the first embodiment, however, the anchor fixture 72*a*, after being positioned leftwardly of the shaft 28*a*, is attached through the sheath 288*a* to the same underlying horizontal bar 302*a* that frames the bottom of the door opening 14*a* and to which the lower mounting fixture 30*a* is fastened.

In installing the assemblies 10, 10*a* of the first and second embodiments, it is desirable to adjust the height of the assemblies to accommodate the person who will be using the assembly. For the assembly 10 of the first embodiment, the method of adjusting the height has been described previously. For the assembly 10*a* of the second embodiment it is simply to be noted that the shoes 190, 192, 242 to which the various pieces of the collapsible assembly 204 are attached and which are to be rigidly connected to the first shaft 28*a* are loosened by loosening their set screws 140*a* and the collapsible assembly 204 is positioned on the shaft 28*a* at the appropriate height.

The first and second embodiments of the handrail assemblies 10 and 10*a* are both pictured as being mounted to the left of the door opening 14, 14*a*. This is because the doors 15, 15*a*, are mounted for rotation about hinges 316, 316*a* which are on the righthand side of each door 15, 15*a*. The doors 15, 15*a* open from the left. Obviously, these embodiments could be modified to be used with lefthand hinged doors.

It is to be understood that various modifications of the foregoing description may be made without departing from the basic teachings of the present invention.

What is claimed is:

1. A collapsible handrail apparatus adapted to be mounted to a wall structure, such as a side wall of a vehicle, said apparatus comprising:

a. a handrail structure having a handrail portion, said handrail structure having a first collapsed position adjacent to said wall structure, and a second extended position in which the handrail portion extends from said wall structure so as to be positioned for handrail support;

b. mounting means by which said handrail structure can be pivotally connected to said wall structure at a first and a second spaced mounting locations for pivotal movement of said handrail structure between said first and second positions;

c. bracing bar means having a first end adapted to be connected to said wall structure at a first bracing location spaced from a line drawn through said two mounting locations, and a second end connected to said handrail structure at a second bracing location spaced from said line extending through said two mounting locations when said handrail structure is in its second extended position;

d. said bracing bar means being characterized in that said bracing means can be extended and retracted so that a distance between said first and second bracing locations can be changed in moving said handrail structure between said first and second positions; and e. locking means for locking the bracing bar means to fix the distance between the first and second bracing positions when the handrail structure is in the extended position;

wherein said first and second mounting locations are positioned so that said line extending through said first and second mounting locations has a substantial vertical alignment component;

said handrail structure being mounted for pivotal movement about an axis substantially transverse to said line extending through said two mounting locations;

said handrail structure comprises a post member having a substantial vertical alignment component in both of said first and second positions, and two arm members connected at outer ends thereof to said post member and at inner ends thereof to said wall structure;

said two arm members and said post member comprise a parallel linkage;

said bracing bar means comprises at least two bracing bars having outer ends connected to said port members of said handrail structure at vertically spaced locations, and two inner ends of said two bracing bars mounted to said wall structure; and said two bracing bars are telescoping bars.

2. The apparatus as recited in claim 1, wherein said two bracing bars are pivotally connected to said wall structure with universal joint connections.

3. The apparatus as recited in claim 1, in which a distance between the points at which the bracing bars are pivotally connected to said handrail structure is different from a distance between the points at which the bracing bars are connected to said wall structure.

4. The apparatus as recited in claim 1, in which:

the mounting means comprises a shaft fixedly attached to the wall structure, where hinges attached to the inner ends of the arm members are connected to the shaft; and a kinked portion is formed on the lower arm member to accommodate the shaft when the handrail structure is in the collapsed position.

5. The apparatus as recited in claim 1, further comprising:

clasp means mounted on the wall structure for receiving the upper arm member when the handrail structure is in the collapsed position; and securing means mounted on the wall structure;

wherein the securing means is wrapped around the handrail structure to secure the handrail structure in the collapsed position when the upper arm member is received within the clasp means.

6. The apparatus as recited in claim 1, further comprising locking means for locking the bracing bar means to fix the distance between the first and second bracing positions when the handrail structure is in the extended position.

7. A collapsible handrail apparatus adapted to be mounted to a wall structure, such as a side wall of a vehicle, said apparatus comprising:

a. a handrail structure having a handrail portion, said handrail structure having a first collapsed position adjacent to said wall structure, and a second extended position in which the handrail portion extends from said wall structure so as to be positioned for handrail support;

b. mounting means by which said handrail structure can be pivotally connected to said wall structure at a first and a second spaced mounting locations for pivotal movement of said handrail structure between said first and second positions;

c. bracing bar means having a first end adapted to be connected to said wall structure at a first bracing location spaced from a line drawn through said two mounting locations, and a second end connected to said handrail structure at a second bracing location spaced from said line extending through said two mounting locations when said handrail structure is in its second extended position;

d. said bracing bar means being characterized in that said bracing means can be extended and retracted so that a distance between said first and second bracing locations can be changed in moving said handrail structure between said first and second positions; and e. locking means for locking the bracing bar means to fix the distance between the first and second bracing positions when the handrail structure is in the extended position;

wherein said two mounting locations are spaced vertically from one another, and said handrail structure is pivotally mounted about a generally vertically aligned axis extending through said two mounting locations, said second bracing location at which the second end of the bracing bar means is connected to said handrail structure being spaced horizontally from said axis of rotation when said handrail structure is in either of said first or second positions; and said bracing bar means comprises at least one telescoping bracing member extending between said first and second bracing locations.

8. The apparatus as recited in claim 7, wherein said handrail structure is mounted for pivotal movement about an axis parallel to said line extending through said first and second mounting locations whereby said handrail structure pivots in a horizontal direction between said first and second positions.

9. The apparatus as recited in claim 7, wherein said handrail structure is a substantially rigid structure.

10. The apparatus as recited in claim 7, further comprising:

clasp means mounted on the wall structure for receiving the upper mounting arm when the handrail structure is in the collapsed position; and securing means mounted on the wall structure;

wherein the securing means is wrapped around the handrail structure to secure the handrail structure in the collapsed position when the upper arm member is received within the clasp means.

11. The apparatus as recited in claim 7, further comprising locking means for locking the bracing bar means to fix the distance between the first and second bracing positions when the handrail structure is in the extended position.

12. A collapsible handrail apparatus adapted to be mounted to a wall structure, such as a side wall of a vehicle, said apparatus comprising a handrail structure comprising a generally vertically aligned post member and upper and lower mounting arms having first outer ends connected to said post member at upper and lower connecting locations, and second inner ends adapted to be pivotally connected to said wall structure at upper and lower spaced mounting locations, in a manner that said handrail structure can be moved between a first collapsed position where said post member and said arms are positioned adjacent to said wall structure and a second extended position where said post member is spaced from said wall structure and said two arms extend outwardly from said wall structure to said post member, said post member maintaining a substantially vertical alignment when moving between said first and second positions, and further comprising bracing bar means having a first end adapted to be connected to said wall structure at a first bracing location spaced from a line drawn through said mounting locations, and a second end connected to said post member of said handrail structure at a second bracing location spaced from said line extending though said two mounting locations when said handrail structure is in its second extended position;

wherein said bracing bar means comprises at least one telescoping bracing member extending between said first and second bracing locations.

13. The apparatus as recited in claim 12, wherein said bracing bar means comprises at least two bracing bars having outer ends connected to said handrail structure at vertically spaced locations, and two inner ends mounted to said wall structure.

14. The apparatus as recited in claim 12, wherein said two arm members and said post member comprise a parallel linkage.

15. The apparatus as recited in claim 12, wherein said two arm members and said post member comprise a parallel linkage.

16. The apparatus of claim 12, in which:

the bracing bar means comprises upper and lower bracing bars, were the bracing bars are connected at an inner end to the wall structure and at an outer end to the handrail structure; and a distance between the points at which the inner ends of the bracing bars are attached to the wall structure is different from a distance between the points at which the outer ends of the bracing bars are attached to the handrail structure.

17. The apparatus as recited in claim 12, further comprising a shaft fixedly attached to the wall structure, where hinges connnected to the inner ends of the upper and lower mounting arms are attached to the shaft to pivotally connect the mounting arms to the wall structure; and a kinked portion is formed on the lower mounting arm to accommodate the shaft when the handrail structure is in the collapsed position.

18. The apparatus as recited in claim 12, further comprising locking means for locking the bracing bar means to fix the distance between the first and second bracing positions when the handrail structure is in the extended position.

* * * * *